US005927214A

United States Patent [19]

Schwartz et al.

[11] Patent Number: 5,927,214

[45] Date of Patent: Jul. 27, 1999

[54] FLAT FOLDING TABLE

[75] Inventors: David L. Schwartz, Florence, Ala.; Johnny D. Ray, Savannah, Tenn.; Jeffrey L. Brannon, Florence, Ala.

[73] Assignee: AHC Inc., Muscatine, Iowa

[21] Appl. No.: 08/871,325

[22] Filed: Jun. 9, 1997

Related U.S. Application Data

[60] Provisional application No. 60/019,545, Jun. 10, 1996.

[51] Int. Cl.[6] ..... A47B 3/00

[52] U.S. Cl. ..... 108/128; 108/115; 108/64; 108/50.02

[58] Field of Search ..... 108/128, 12, 115, 108/50.01, 50.02, 64; 16/326, 327, 331, 332

[56] References Cited

U.S. PATENT DOCUMENTS

| | | | |
|---|---|---|---|
| 2,708,146 | 5/1955 | Adler | 108/115 |
| 2,750,243 | 6/1956 | Zielfeldt | 108/115 |
| 2,971,803 | 2/1961 | Wallin | 16/326 |
| 3,861,329 | 1/1975 | Kitchen, Sr. | 16/326 X |
| 4,602,889 | 7/1986 | Mu-Shan | 16/332 X |
| 5,182,996 | 2/1993 | Gutgsell | 108/64 |
| 5,337,657 | 8/1994 | Diffrient | 108/50.02 X |
| 5,549,055 | 8/1996 | Kusch | 108/115 X |
| 5,568,773 | 10/1996 | Hung | 108/50.01 X |
| 5,640,912 | 6/1997 | Diffrient | 108/50.02 |
| 5,690,403 | 11/1997 | Ellison et al. | 108/50.02 X |

FOREIGN PATENT DOCUMENTS

| | | | |
|---|---|---|---|
| 754962 | 3/1967 | Canada | 108/115 |
| 9718 | of 1896 | United Kingdom | 108/115 |
| 2137488 | 10/1984 | United Kingdom | 108/115 |
| 9003132 | 4/1990 | WIPO | 108/115 |

*Primary Examiner*—Peter M. Cuomo
*Assistant Examiner*—Hanh V. Tran
*Attorney, Agent, or Firm*—Jones, Day, Reavis & Pogue

[57] ABSTRACT

A table foldable between an open and a flat position is disclosed. The table includes a table top, a modesty panel, and legs. The legs are hinged to the modesty panel so as to fold flat relative thereto. The tabletop is connected to the modesty panel by a top hinge having a pivot point offset from the modesty panel so that the tabletop can fold into a flat position over the legs when the legs are in their flat position. A lock is provided to lock the tabletop in its flat position.

12 Claims, 8 Drawing Sheets

FLAT FOLDING TABLE

CROSS-REFERENCE TO RELATED APPLICATION

This application claims the benefit of U.S. Provisional Application No. 60/019,545 filed Jun. 10, 1996.

BACKGROUND

1. Field of the Invention

This invention relates generally to furniture and, more particularly, to a table that can fold flat for easy storage.

2. Background of the Invention

Tables that can be easily stored, transported, and erected are desirable for many types of use. One example is contemporary training environments such as hotels, convention centers, schools, colleges, and work places where it is common practice to set up temporary training classrooms. Tables used in such environments are constantly being moved and set up, and should have the ability to be stored with minimum space when not in use. Such tables should also be sufficiently supported and capable of working in contemporary environments such as with computers where many cables and wires are run to each table.

Foldable tables that can be folded to require less storage space are broadly known, but certain disadvantages flow from each proposed prior art solution to this problem. Improvement to known tables has been found to be possible and is herein disclosed for use in today's multi-purpose community and training room environments.

Accordingly, one object of the present invention is to provide a table that can fold substantially flat for easy storage and transport.

Another object is to provide a table that is easily set up for use.

A further object of the present invention is to provide a table having a top hinge that allows the tabletop to fold over the folded legs.

Another object is to provide a table that is easily locked into its flat position to ease handling.

Additional objects, advantages and novel features of the invention will be set forth in part in the description and drawings which follow, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention provides a table foldable into a flat position that is easy to store, transport, and set up into its open position. Broadly, the invention provides a table having a tabletop, a modesty panel, and at least two legs supporting the table. Each leg is hingeably attached to the modesty panel so that each can move from its extended position underneath the tabletop to a substantially flat position relative to the modesty panel. A top hinge attaches the tabletop to the modesty panel. The top hinge has a front hinge section fixed to the modesty panel and a rear hinge section fixed to the tabletop. The two hinge sections are pivotally connected to each other at a pivot point which is offset from the modesty panel so that the tabletop can fold into a substantially flat position over the legs when the legs are in their flat position. The top hinge further has a lock to temporarily lock the tabletop in its folded position.

A preferred lock includes a slide bolt slidably fixed to the rear hinge section. A locking notch is provided with the front hinge section and positioned to receive the slide bolt when the tabletop is in the flat position. A spring urges the slide bolt towards the locking notch when the slide bolt is aligned with the notch.

BRIEF DESCRIPTION OF THE DRAWINGS

The foregoing Summary as well as the following Detailed Description, will be better understood when read in conjunction with the accompanying drawings. For the purpose of illustrating the invention, there is shown in the drawings a preferred embodiment. It is understood, however, that this invention is not limited to the precise arrangement shown.

DETAILED DESCRIPTION

Figure 1:
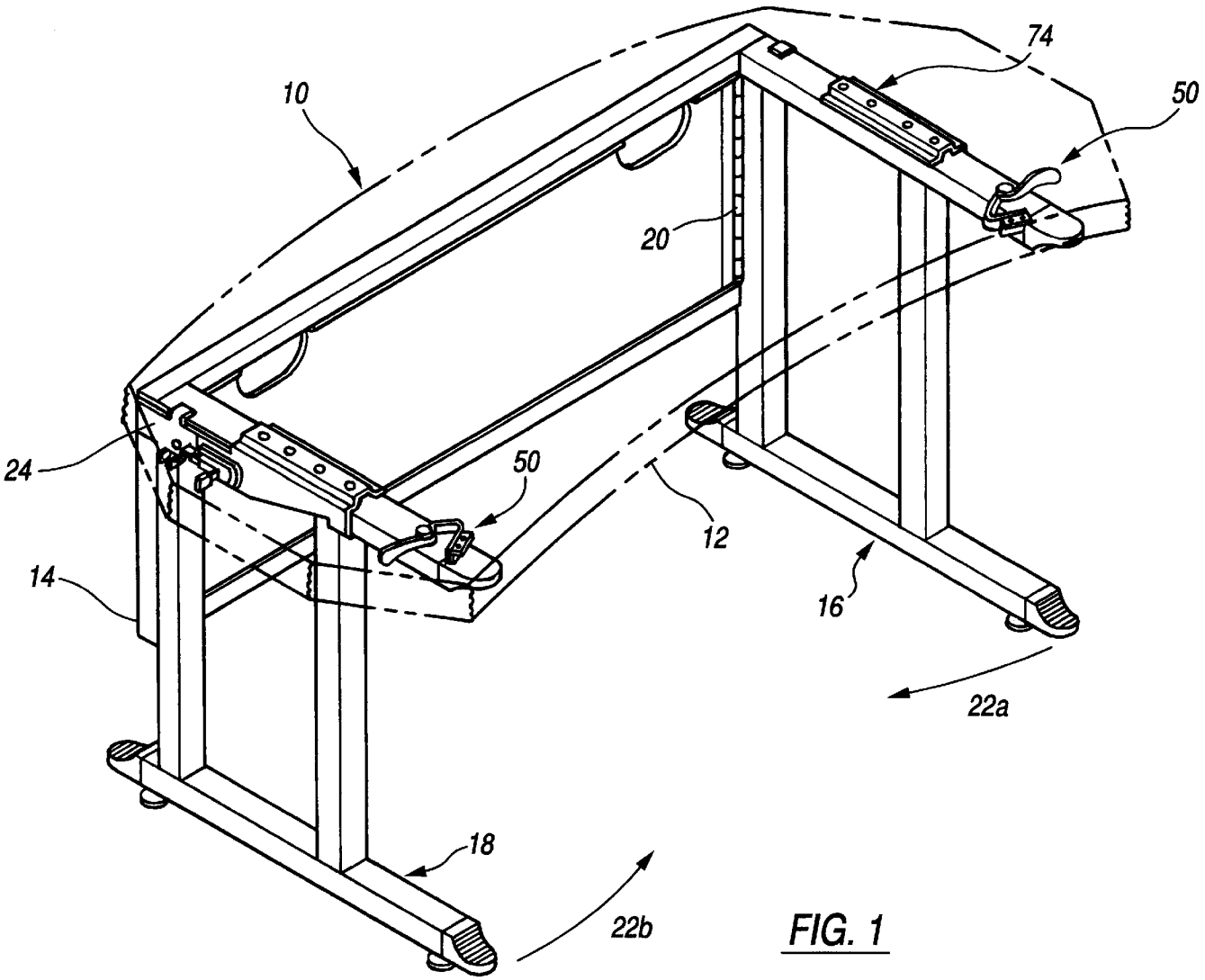
FIG. 1 is a perspective view from the front of a table made in accordance with the present invention with the under structure appearing visible through the tabletop for the sake of clarity.

Reference is now made to the drawings illustrating a preferred embodiment of the invention. Shown in FIGS. 1, 2, and 3 is a foldable table 10 having a tabletop 12, a modesty panel 14 on the front end of the table, and a right leg 16 and a left leg 18 for supporting the table.

Figure 2:
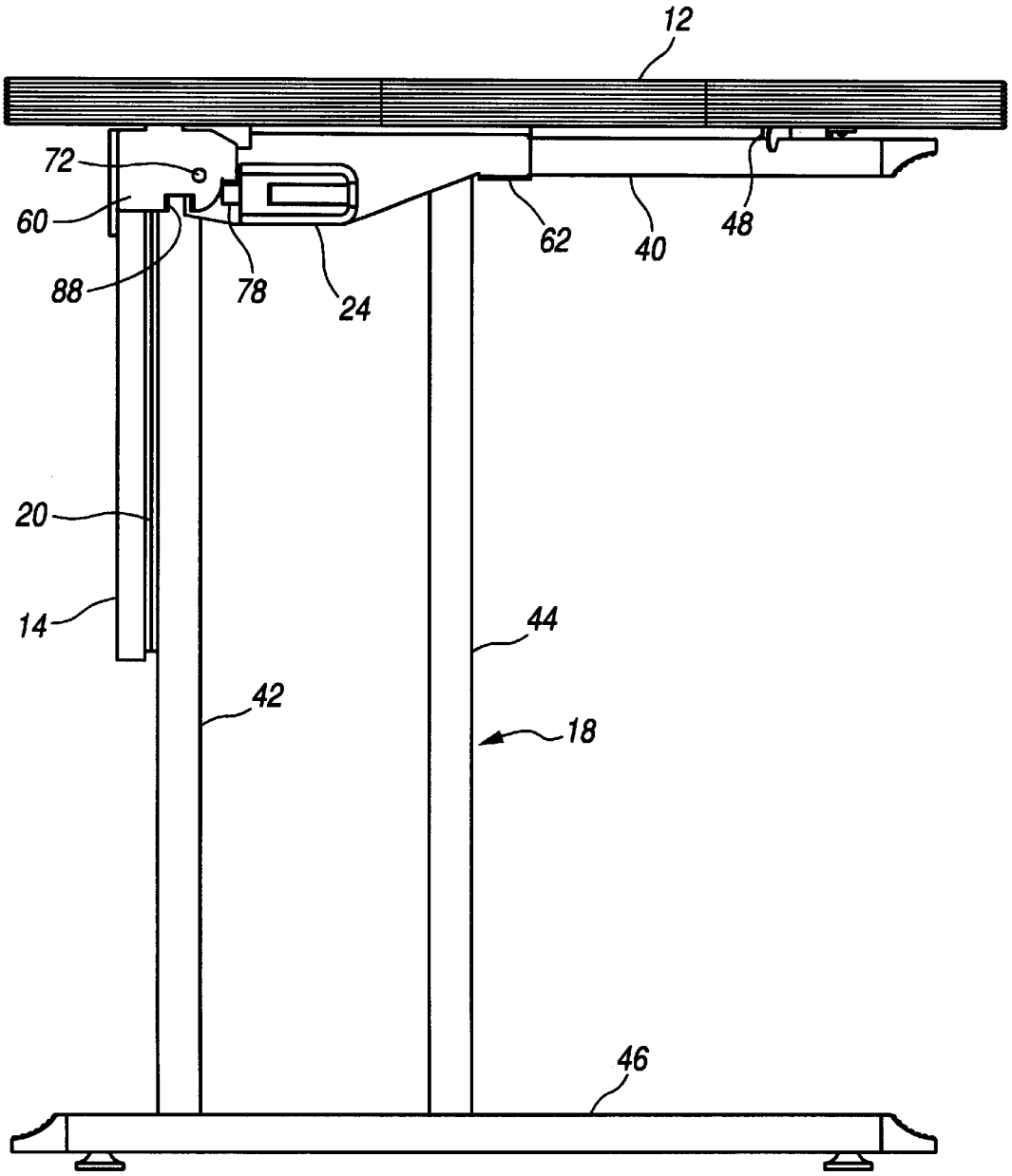
FIG. 2 is a side view, on an enlarged scaled, of the table shown in FIG. 1.
Figure 3:
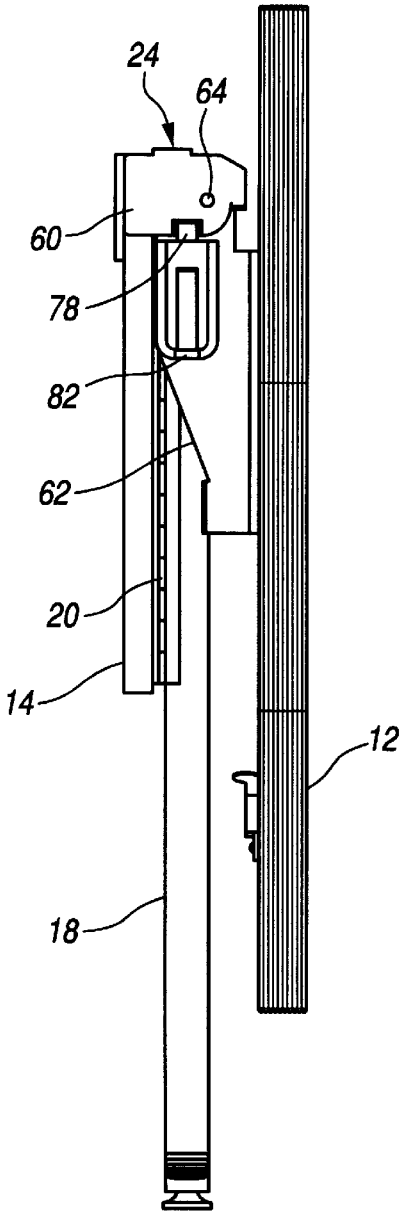
FIG. 3 is a side view of the table shown in FIG. 1 showing the table in its flat position.

The table 10 is foldable between an open position as shown in FIGS. 1 and 2, and a substantially flat position as shown in FIG. 3 where the legs 16, 18 and tabletop 12 are folded. The legs 16 and 18 are each hingeably connected to the modesty panel 14 by a leg hinge 20 which allows the legs 16, 18 to move as shown by arrows 22*a*, 22*b* (FIG. 1) to their flat position adjacent the modesty panel 14. Any suitable hinge may be used.

The tabletop 12 is attached to the modesty panel 14 by a top hinge 24 which allows the top 12 to fold to its substantially flat position over the legs 16, 18 as shown in FIG. 3. Thus, as shown in FIG. 3, the table 10 is easily folded into a flat position for storage and transportation.

The top 12 can be constructed of any suitable material. For the preferred embodiment, it is constructed of a wood composite board laminated with a high-pressure laminate on the top, phenolic resin backer, and edge circumference with a plastic T-molding. Threaded steel inserts are provided in the underside of the table for attaching the top 12 to the top hinge 24 as further described below. The tabletop is shaped to allow the table to be connected to other like tables to form a wide range of configurations. This feature is further discussed in U.S. patent application Ser. No. 08/642,750, filed May 3, 1996, entitled: "*Table Having Tripartite End Segments and System Utilizing Same*," assigned to the assignee of the present application, which is hereby incorporated by reference.

Figure 4:
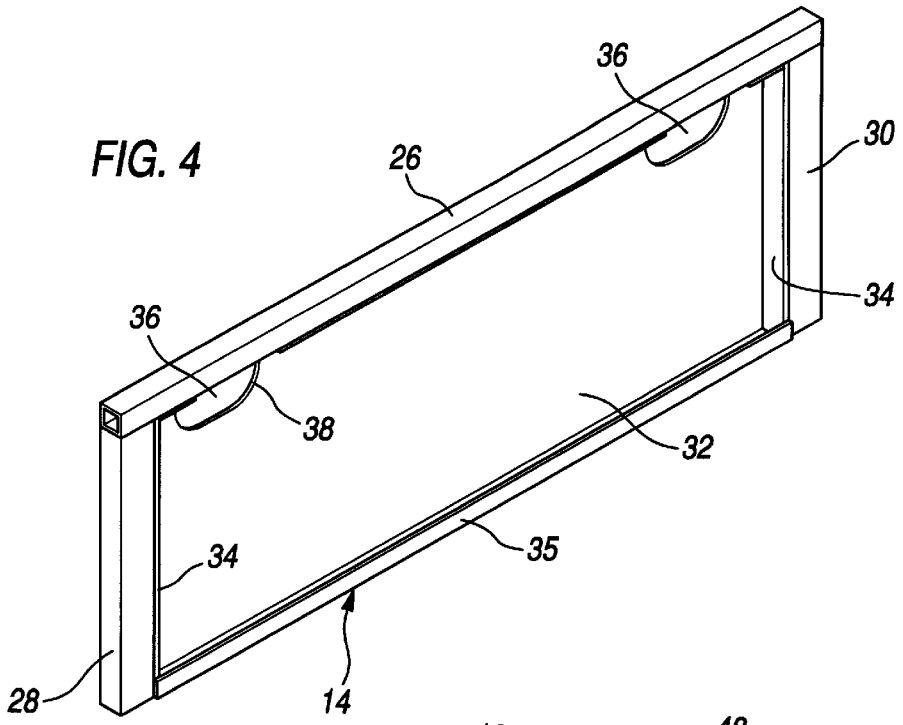
FIG. 4 is a perspective view of the modesty panel of the table shown in FIG. 1.

The modesty panel 14 is now described with reference to FIG. 4 showing the modesty panel from the front side of the table 12 (FIG. 1 is a frontal view). In the illustrated embodiment, the modesty panel 14 has a steel tube 26 across the top, and two steel tubes 28 and 30 on each side fixed together by means such as welding. A formed sheet metal panel 32 in the center having folded ends 34 and a J-shaped bottom end 35 for rigidity is mig welded to the steel tubes 26, 28, 30.

Figure 5:
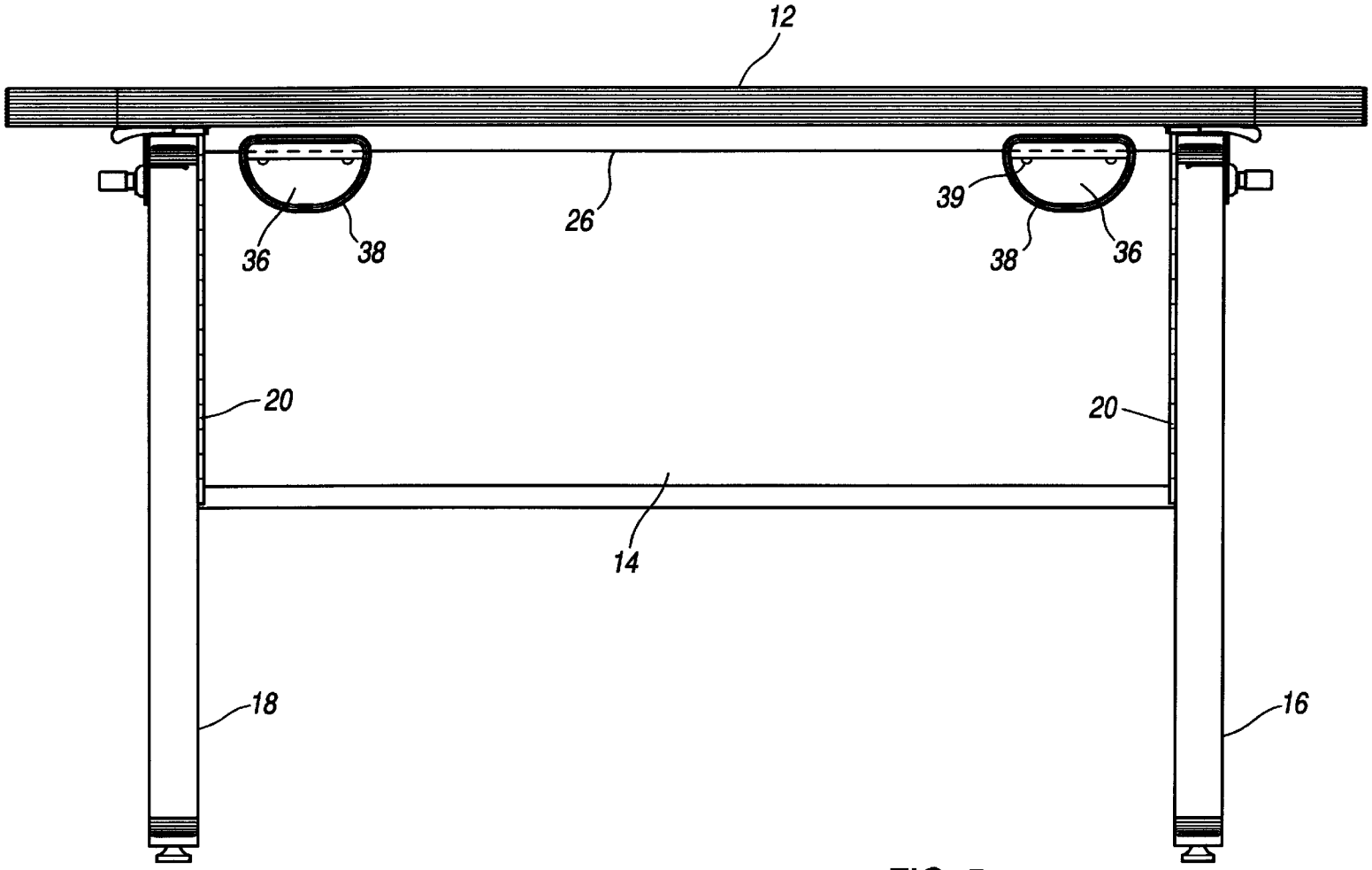
FIG. 5 is a rear view of the table shown in FIG. 1.

With reference to FIGS. 4 and 5, the modesty panel 14 has openings 36 at the top of the sheet metal panel 32 to be used to carry the flat folded table 10 and for running wires and cables to the table. The top of the opening 36 is bordered by the steel tube 26 which acts as a handle. A grommet 38 having a flange 39 screwed to the underside of the steel tube 26 covers the potentially sharp sheet metal edges and provides an aesthetic appearance.

Referring to FIGS. 1 and 2, the left and right legs 16 and 18, respectively, have a top arm 40 which supports the tabletop 12, a vertical member 42 adjacent the modesty panel 14, a second vertical member 44, and a bottom member 46. The top arm 40, vertical member 42, second vertical member 44, and bottom member 46 are each made of steel tubes welded together to form a complete leg 16, 18.

A spacer member 48, such as a spacer button made of plastic as shown in FIG. 2 is attached to the top arm 40 with a screw. The spacer member 48 supports the underside of the tabletop 12 in a spaced relationship from the top arm 40 as shown, and further acts as a locking member as further described below.

Figure 6:
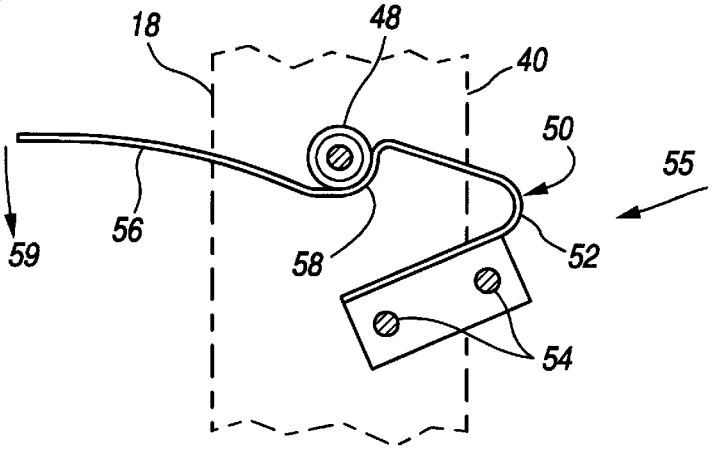
FIG. 6 is a top view of a leg lock locking one of the legs of the table shown in FIG. 1.
Figure 6A:
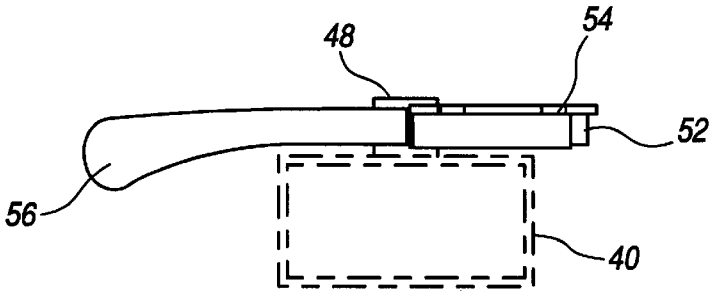
FIG. 6A is a side view of a leg lock shown in FIG. 6.

Leg locks 50 are provided to temporarily lock each leg 16, 18 in its open position (see FIG. 1). A preferred leg lock is described with reference to FIGS. 1, 6, and 6A. The leg lock 50 has a spring bracket 52 fixed with screws through screw holes 54 to the underside of the tabletop 12. The spring bracket 52, made out of a suitable material, such as spring steel, is shaped to hold the spacer member 48 which is attached to the top arm 40 of a leg 18. It is seen that the leg 18 is swung in the direction 55 as shown into its opened position, the spacer member 48 contacts the leg lock spring 52, moving the spring 52 back to allow the spacer member 48 to pass. The leg lock spring 52 springs back into place to lock the leg in its open position by holding the spacer member 48 at the curved holding area 58. The leg 18 is released for folding into its flat position by moving the handle 56 in the direction 59 as shown to release the spacer member 48. A similar leg lock is used for the leg 16, although the spring bracket used with the leg 16 is a mirror image of the leg lock 50 used with the leg 18 since the leg 16 swings in the opposite direction.

Figure 7A:
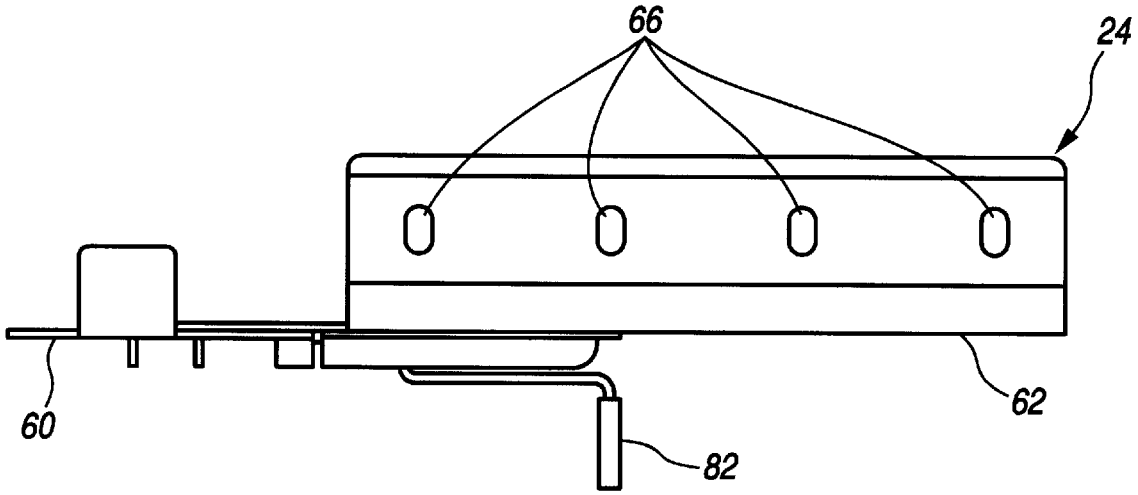
FIG. 7A is a top view of the top hinge shown in FIG. 7.
Figure 7:
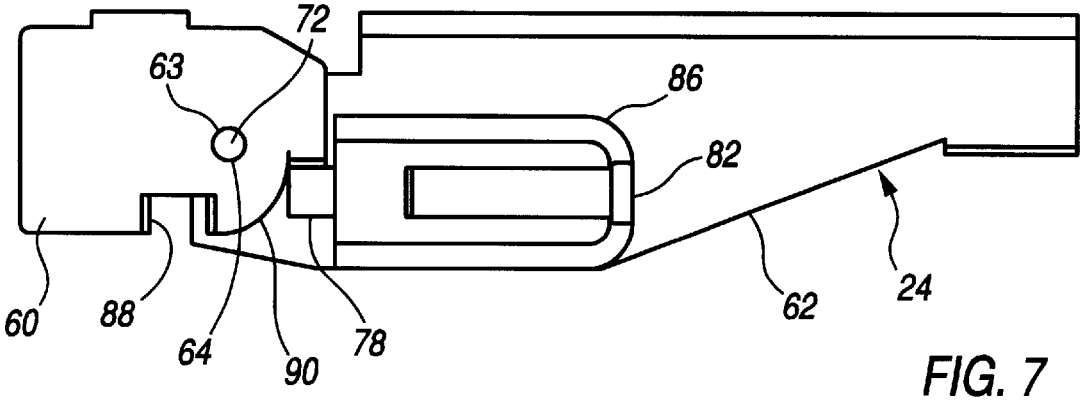
FIG. 7 is a side view of a top hinge of the table shown in FIG. 1.
Figure 7B:
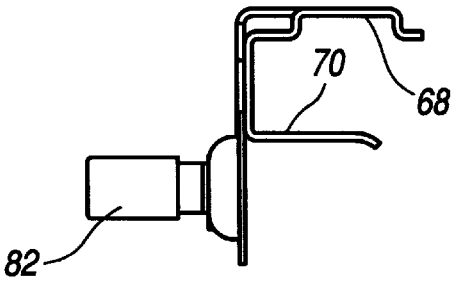
FIG. 7B is a front view of the top hinge shown in FIG. 7.

The top hinge 24 connecting the tabletop 12 to the modesty panel 14 is illustrated with reference to FIGS. 2, 3, 7, 7A, 7B, and 8 showing the top hinge 24 on the left side of the table 10. The top hinge 24 includes two sections as shown in FIG. 7—a front hinge section 60 fixed to the modesty panel 14, and a rear hinge section 62 fixed to the underside of the tabletop 12. The top hinge sections 60 and 62 are connected to each other at pivot point 64.

The front hinge section 60 is welded to the side of the modesty panel 14 as shown in FIG. 2 and 3 where it does not interfere with the folding of the leg 18. It is made of heavy gauge steel and formed with a hole 63 for the pivot point 64. The hole 63 is offset from the modesty panel 14 to allow the tabletop 12 pivoting about pivot 64 to fold over the folded legs 16, 18 (see FIG. 3).

Figure 9:
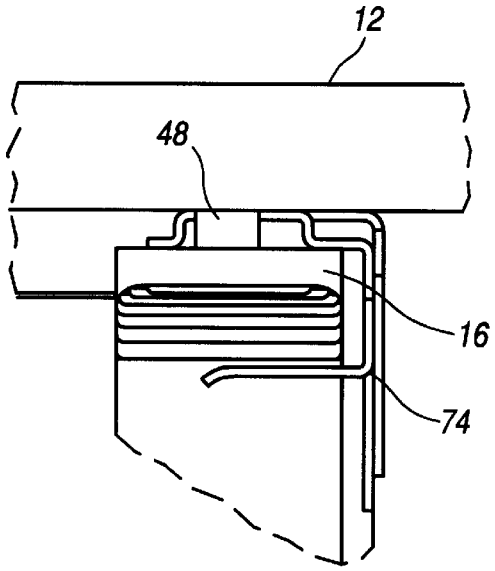
FIG. 9 is a partial rear view showing the top arm of a leg supporting the tabletop.

The rear hinge section 62 is fixed to the underside of the tabletop 12 with mounting screws through screw holes 66 into the threaded steel inserts provided in the underside of the tabletop 12 as previously discussed (FIGS. 1, 7, 7A). The rear hinge section 62 is formed with a recess 68 (FIG. 7B) to allow the leg 18 to pass under the mounting screws in screw holes 66 and with suitable mounting area for the weight of the tabletop 12 and the number of screws. The rear hinge section 62 may further have a C-shaped mounting section 70 (FIG. 7B) for receiving and holding the top arm 40 of the leg 18 when the leg 18 is in its open position. (See FIG. 9 showing the leg 16 in a second top hinge 74 on the right side of the table 12). Heavy gauge steel is preferred for forming this section. A hole 71 (FIG. 8) corresponding to the hole 63 in the front hinge section 60, is provided through which a large, heavy-duty solid rivet 72 pivotally connects the rear hinge section 62 with the front hinged section 60 at pivot point 64.

As previously discussed, the pivot point 64 is positioned so that the tabletop 12, folding about the pivot point 64, will fold over the folded legs 16, 18 to allow the tabletop 12 to fold flat, forming the flat position of the table 10 with the legs 16, 18 sandwiched between the modesty panel 14 and the tabletop 12. The flat folded table is conveniently stored and transported in this position. Moreover, the folded tabletop 12 allows easy access to the handle openings 36 for carrying the folded table.

Two such top hinges are shown, the top hinge 24 on the left side of the table 10, and the second top hinge 74 on the right side of the table. These two hinges 24 and 74 are mirror images of each other with the exception that the left top hinge 24 includes a lock 76 to lock the tabletop 12 in its folded position.

Figure 8:
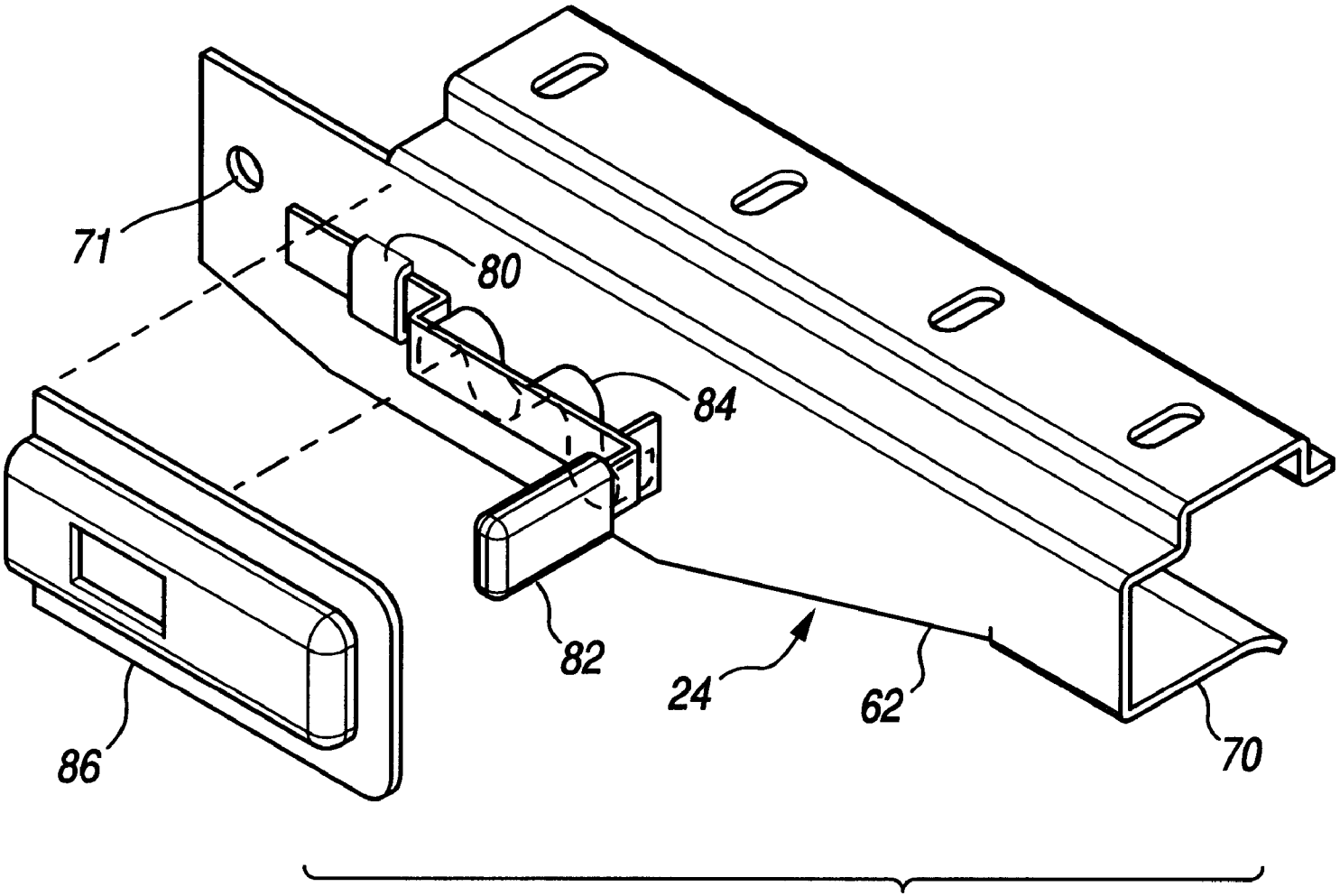
FIG. 8 is an exploded view of the rear hinge section of the top hinge shown in FIG. 7.

Referring to FIGS. 2, 3, 7, and 8, the lock 76 of the illustrated embodiment is an integral part of the top hinge 24. A slide bolt 78 is movably secured to the rear hinge section 62 by a U-shaped saddle 80 formed in the side of the rear hinge section 62 (FIG. 8). The slide bolt 78 is shaped as shown to form a handle 82 for operating the lock, and to abut one end of a spring 84, such as the "S" spring shown, which urges the slide bolt 78 towards the front hinge section 60. A cover cap 86 made of sheet metal is spot welded in place over the spring 84 which fixes the other end of the spring 84 in place.

The lock 76 further includes a locking notch 88 (FIG. 7), fixed to the front hinge section 60 and which is positioned to receive the slide bolt 78 when the tabletop 12 is in the folded position (see FIG. 3). As illustrated, the locking notch 88 can be integrally formed as part of the front hinge section 60. The front hinge section 60 also has a curved surface 90 (FIG. 7) which engages the slide bolt 78 as the tabletop 12 moves from its open position to its flat position. In moving to the flat position of FIG. 3, the slide bolt 78 moves against the urging of the spring 84 until the slide bolt 78 reaches the locking notch 88 and "snaps" therein to lock the tabletop 12, as well as the entire table 10, in the flat position as shown in FIG. 3. To open the tabletop 12 from the flat position, the handle 82 is pulled away from the locking notch 88 to release the slide bolt 78 therefrom at which time the tabletop 12 can be moved to its open position.

Only one top hinge lock 76 is required to lock the table 10 in the flat position. The lock 76 can be included with the second top hinge 74 on the right side rather than or in addition to the lock 76 with the left top hinge 24.

Figure 10:
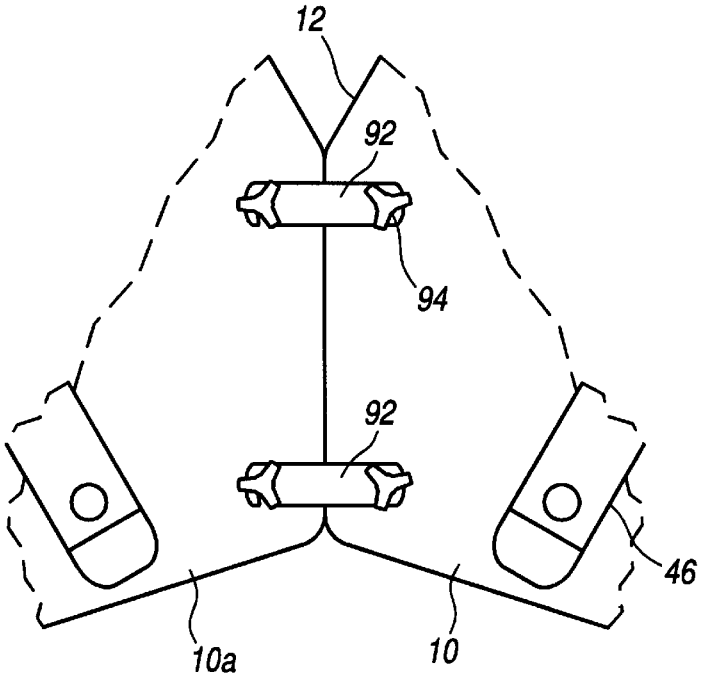
FIG. 10 is a bottom view of the table shown in FIG. 1 connected to another table.

The present invention is ideal for use where tables are constantly being repositioned and stored between uses. The table is easily carried to the desired position by use of the handles provided by openings 36. To open, the handle 82 of lock 76 is pulled to release the lock 76. The tabletop 12 is then moved to its opened position and the legs 16, 18 swung into their opened position extending under and supporting the tabletop 12. The top arm 40 of each leg 16, 18 is moved into the C-shaped section 70 of the respective top hinge 72, 24 until the leg spring 52 takes hold of the spacer member 48 to lock the legs in place. This completes the table setup. Wires and cables run to equipment on the table can pass through the openings 36 in the modesty panel 14. Multiple tables 10, 10*a* can be connected together with connector brackets 92 as shown in FIG. 10. Connected at one end to the underside of the tabletop 12, the bracket is slotted to connect to screw 94 having knobs which can be tightened to secure the two tables 10 and 10*a* together.

To fold the table to its flat position, the handle 56 of the leg locking springs 52 are pulled to release the legs 16 and 18 which can then be folded flat against the modesty panel 14. The tabletop 12 is then folded down flat until the lock 76 of the left top hinge 24 locks the tabletop in place. The legs, being sandwiched between the tabletop 12 and the modesty panel 14, is thus also locked in the flat position.

Figure 11:
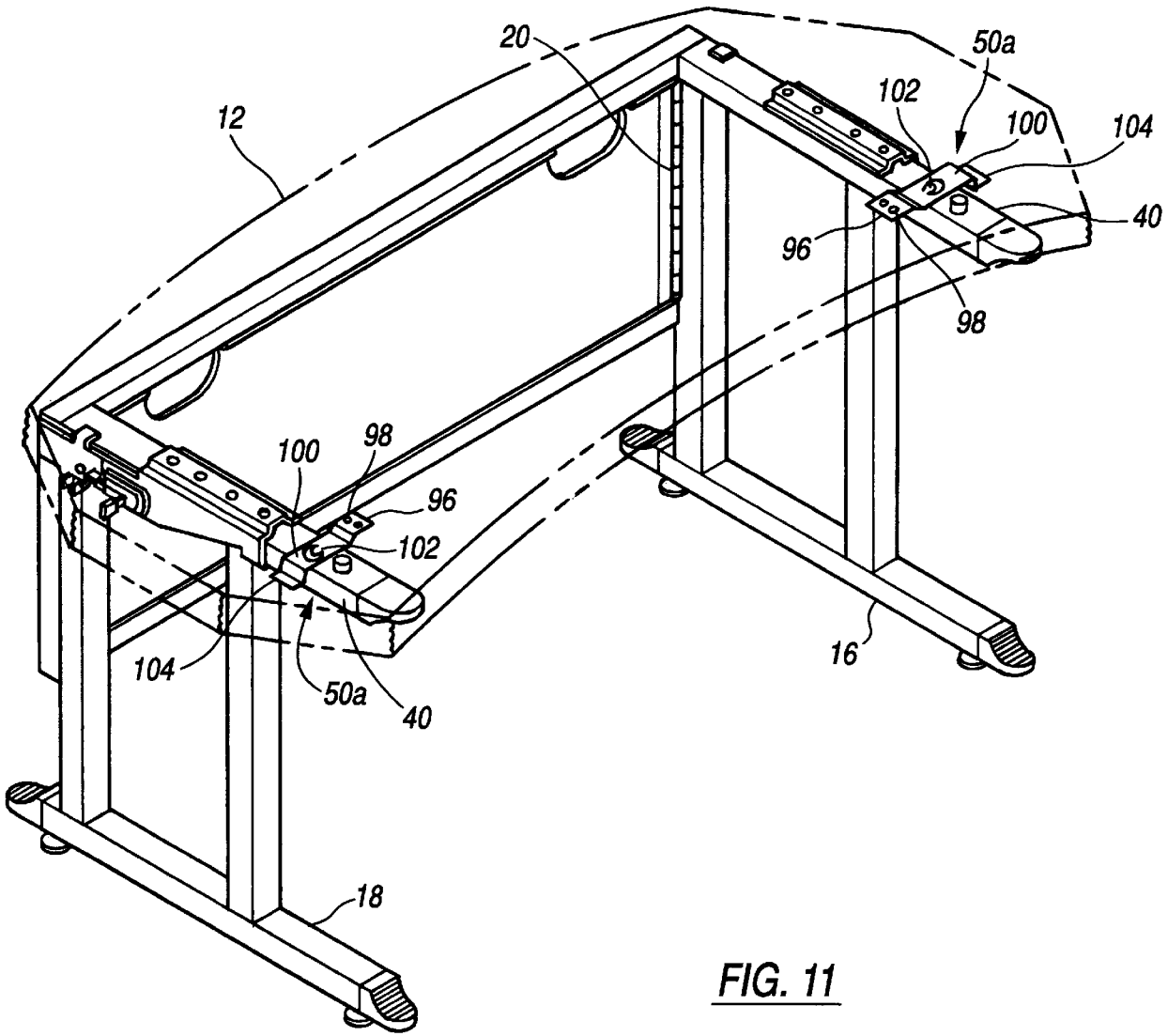
FIG. 11 is a perspective view from the front of the table showing a second embodiment of a leg lock.

A second type of leg lock 50*a* suitable for use with the table 10 is illustrated in FIG. 11. Leg lock 50*a* comprises a mounting flange 96 secured to the underside of tabletop 12 by fasteners 98 such as screws. Integrally cantilevered from bracket 96 is a flat spring plate 100 having a downwardly extending engaging member 102 such as the tab shown which is punched from the surface of plate 100. A manual release flange 104 extends from the end of spring plate 100 and is formed as an integral angled section of spring plate 100 as shown. Preferably, leg lock 50*a* is formed from a spring steel or similar material and is preformed to extend downwardly at a relatively shallow angle from the undersurface of tabletop 12. Each leg lock 50*a* engages the top arm 40 of legs 16 and 18 when the legs are pivoted outwardly on leg hinges 20 to support tabletop 12. The engaging member 102 on each lock 50*a* engages an opening positioned in each respective top arm 40 to lock the legs 16, 18 in place when the legs are in the fully open position. When it is desired to fold the table, leg locks 50*a* can be disengaged from top arms 40 by manually forcing release flanges 104 upward away from top arm 40, thereby bending cantilevered spring plate 100 and removing the engaging member 102 from the opening in the top arms 40 to permit movement of the legs.

While a particular embodiment of the invention is described herein, it is not intended to limit the invention to such disclosure. Changes and modifications made be incorporated and embodied within the scope of the appended claims.

What is claimed is:

1. A table foldable between an open and a flat position, said table comprising:

a table top;

a modesty panel;

at least two legs for supporting the table each leg comprising a vertical member hingeably attached to said modesty panel allowing said leg to move into a substantially flat position relative to said modesty panel when said table is in the flat position and allowing said leg to extend underneath said table top to support said table top when said table is in the open position, each said leg including a top arm member supporting the underside of said table top when said table is in the open position;

a top hinge attaching said table top to said modesty panel, said top hinge having a front hinge section fixed to said modesty panel and a rear hinge section fixed to said table top, said front and rear sections being pivotally connected to each other at a pivot point offset from said modesty panel so that said table top can fold into a substantially flat position relative to said modesty panel over said legs when the legs are in the flat position, said top hinge further comprising a lock to temporarily lock said table top in the folded position; and a leg lock fixed to the underside of said table top for locking said table top to said legs when said table is in the open position, said leg lock comprising a locking spring fixed to the underside of said table top and shaped to secure one of said legs when the table is in the open position, said locking spring being moveable to release said one leg to allow the leg to fold into its flat position.

2. A table in accordance with claim 1 wherein said lock comprises:

a moveable slide bolt secured to said rear hinge section and having a handle;

a locking notch fixed to said front hinge section and disposed to receive said slide bolt when said table top is in the folded position; and a spring urging said bolt towards said locking notch.

3. A table in accordance with claim 2 wherein said modesty panel comprises multiple openings sized to accept hands for carrying the table and for wire management.

4. A table in accordance with claim 3 further comprising a grommet fixed around the inside edge of each said openings in said modesty panel.

5. A table in accordance with claim 1 further comprising a spacer member attached to the top arm member of each said leg to support the underside of said table top in a spaced relationship relative to said top arm; and wherein said locking spring is shaped to engage and hold said spacer member when said table is in the open position, and wherein said locking spring includes a handle to release said spacer member.

6. A table in accordance with claim 1 wherein said lock comprises:

a moveable slide bolt secured to said rear hinge section and having a handle;

a locking notch fixed to said front hinge section and disposed to accept said slide bolt when said table top is in the folded position; and a spring urging said bolt towards said locking notch.

7. A table foldable between an open and a flat position, said table comprising:

a table top;

a modesty panel;

at least two legs for supporting the table, each leg being hingeably attached to said modesty panel allowing said leg to move to a substantially flat position, relative to said modesty panel when said table is in the flat position and allowing said leg to extend underneath said table top to support said table top when said table is in the open position, each of said legs comprising a vertical member hingeably attached to said modesty panel, and a top arm member supporting the underside of said table top when said table is in the open position, said top arm including a spacer member disposed to support the underside of said table top in a spaced relationship relative to said top arm when said table is in the open position;

a bracket fixed to the underside of said table top shaped to engagingly secure said spacer member when said table is in the open position, said bracket including a handle to release said spacer member; and a top hinge attaching said table top to said modesty panel, said top hinge comprising:

(a) a rear hinge section secured to the underside of the table top;

(b) a slide bolt slidably fixed to the said rear hinge section;

(c) a front hinge section secured to the modesty panel, said front hinge section having a locking notch adapted to receive said slide bolt when said table top is in the flat position;

(d) said front and rear hinge sections being pivotally connected to each other at a point offset from said modesty panel so that said table top can fold into a substantially flat position relative to said modesty panel over said legs when the table is in the flat position; and (e) a spring disposed to urge said slide bolt toward said locking notch to lock said table in its flat position.

8. A table in accordance with claim 7 further comprising a leg lock fixed to the underside of said table to securely hold one of said legs in the open position.

9. A table in accordance with claim 7 further comprising a second top hinge attaching said tabletop to said modesty panel, said second top hinge comprising a second rear hinge section secured to the underside of the tabletop and a second front hinge section secured to the modesty panel, said second rear and front sections being pivotally connected to each other at a point offset from said modesty panel so that said table top can fold into a substantially flat position relative to said modesty panel over said legs when the table is in the flat position.

10. A table in accordance with claim 7 wherein said front and rear hinge sections are pivotally connected to each other with a rivet.

11. A table in accordance with claim 7 further comprising a connector bracket on the underside of the table for securing said table to another table.

12. A table in accordance with claim 7 wherein said tabletop has a convex front side, a concave rear side, and at least one end having tripartite edge segments.

* * * * *